US007029099B2

(12) United States Patent
Lebens et al.

(10) Patent No.: US 7,029,099 B2
(45) Date of Patent: Apr. 18, 2006

(54) METHOD OF PRODUCING INK JET CHAMBERS USING PHOTO-IMAGEABLE MATERIALS

(75) Inventors: John A. Lebens, Rush, NY (US); Thomas M. Stephany, Churchville, NY (US)

(73) Assignee: Eastman Kodak Company, Rochester, NY (US)

( * ) Notice: Subject to any disclaimer, the term of this patent is extended or adjusted under 35 U.S.C. 154(b) by 18 days.

(21) Appl. No.: 10/697,595

(22) Filed: Oct. 30, 2003

(65) Prior Publication Data

US 2005/0095538 A1 May 5, 2005

(51) Int. Cl.
*B41J 2/04* (2006.01)

(52) U.S. Cl. ..... 347/54

(58) Field of Classification Search ..... 347/20, 347/40, 47, 54, 56, 65; 29/890.1; 430/320, 430/324, 394, 396; 216/2, 27
See application file for complete search history.

(56) References Cited

U.S. PATENT DOCUMENTS 5,030,317 A * 7/1991 Noguchi ..... 216/27
5,478,606 A 12/1995 Ohkuma et al. ..... 427/555
5,686,224 A 11/1997 O'Neill
6,162,589 A * 12/2000 Chen et al. ..... 430/320
6,310,641 B1 * 10/2001 Mrvos et al. ..... 347/47
6,406,134 B1 * 6/2002 Hu et al. ..... 347/65
6,638,439 B1 * 10/2003 Shimomura ..... 216/27
6,709,805 B1 * 3/2004 Patil ..... 430/320
6,773,869 B1 * 8/2004 Patil ..... 430/320
2003/0146955 A1 8/2003 Imamura

FOREIGN PATENT DOCUMENTS

EP 0 940 257 A2 9/1999
GB 2 189 746 A 11/1987

* cited by examiner

*Primary Examiner*—Anh T. N. Vo
(74) *Attorney, Agent, or Firm*—Peyton C. Watkins

(57) ABSTRACT

A method for creating one or more ink jet chambers, the method includes the steps of providing a substrate having a thermal element covered with substantially one type of uncured photo-imageable material; providing a first mask spanning the thermal element which creates both masked and unmasked uncured photo-imageable regions; exposing the unmasked photo-imageable region; providing a second mask covering at least a portion of the thermal element; exposing a portion of the remaining unexposed photo-imageable region for forming an output nozzle; curing the exposed portions of the photo-imageable material; and removing all the remaining uncured photo-imageable material for creating the ink jet chamber.

13 Claims, 5 Drawing Sheets

METHOD OF PRODUCING INK JET CHAMBERS USING PHOTO-IMAGEABLE MATERIALS

FIELD OF THE INVENTION

The invention relates generally to the field of ink jet recording heads, and in particular to a method of manufacturing an ink jet chamber. More specifically, the invention relates to the manufacture of specific ink jet chambers that enhance the performance of the ink jet recording process.

BACKGROUND OF THE INVENTION

An ink jet recording head typically includes outlets or nozzles that serve to eject tiny droplets of liquids used in a recording process onto a media, such as any suitable paper. Situated behind those nozzles is a chamber that contains either ink or fluid and a mechanism of either electrically or mechanically ejecting the ink or fluid onto a suitable receiver.

A more conventional method of manufacturing an ink jet recording head is represented in U.S. Pat. No. 5,478,606 by Ohkuma et. al., wherein a method of manufacturing an ink jet recording head has the steps of (1) forming an ink flow path pattern on a substrate with the use of a dissoluble resin, the substrate having ink ejection pressure generating elements thereon; (2) forming on the ink flow path pattern a coating resin layer, which will serve as ink flow path walls, by dissolving in a solvent a coating resin containing an epoxy resin which is solid at ordinary temperatures, and then solvent-coating the solution on the ink flow path pattern; (3) forming ink ejection outlets in the coating resin layer above the ink ejection pressure generating elements; and (4) dissolving the ink flow path pattern.

Consequently, a need exists for forming a ink jet chamber which reduces complexity, reduces manufacturing steps and lowers costs.

SUMMARY OF THE INVENTION

The present invention is directed to overcoming one or more of the problems set forth above. Briefly summarized, according to one aspect of the present invention, a method is detailed for the creation of one or more ink jet chambers, the method comprising the steps of providing a substrate having a thermal element covered with substantially one type of uncured photo-imageable material; providing a first mask spanning the thermal element which creates both masked and unmasked uncured photo-imageable regions; exposing the unmasked photo-imageable region; providing a second mask covering at least a portion of the thermal element; exposing a portion of the remaining unexposed photo-imageable region for forming an output nozzle; curing the exposed portions of the photo-imageable material; and removing all the remaining uncured photo-imageable material for creating the ink jet chamber.

The above and other objects of the present invention will become more apparent when taken in conjunction with the following description and drawings wherein identical reference numerals have been used, where possible, to designate identical elements that are common to the figures.

ADVANTAGEOUS EFFECTS OF THE INVENTION

The present invention has the following advantages in that a thermal element covered with substantially one type of uncured photo-imageable material is used in the creation of an ink jet chamber. This method when considered over the prior art provides significant advantage in reduced complexity, reduced manufacturing steps and lower costs.

DETAILED DESCRIPTION OF THE INVENTION

Figure 1A:
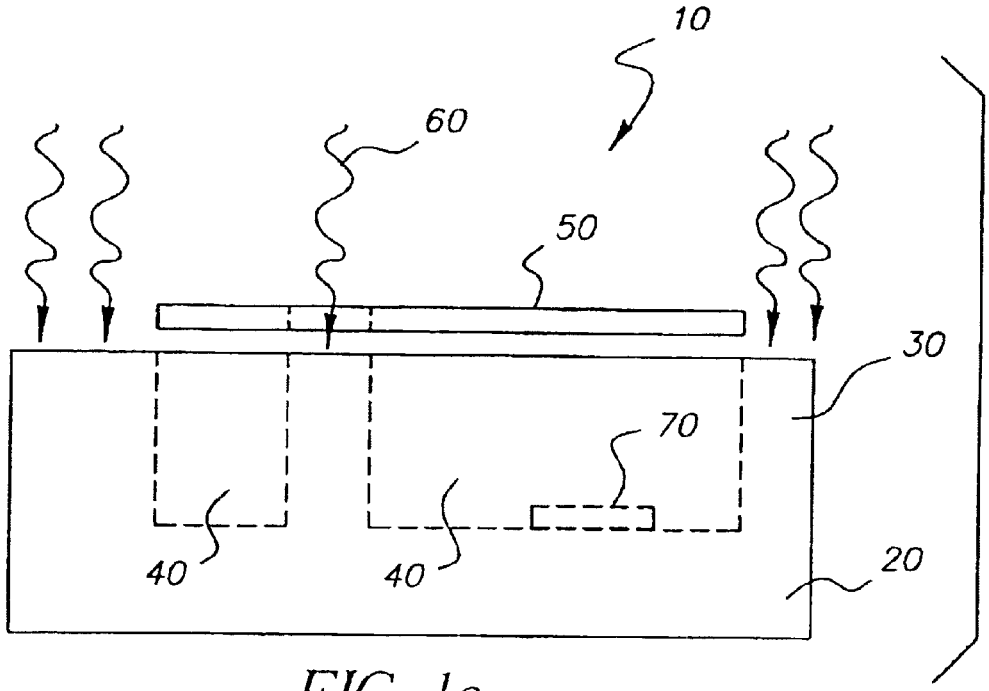
FIG. 1*a* is a side view of an ink jet chamber of the present invention positioned upon a substrate, showing the creation of features by exposing a photo-imageable material through a first mask.

Referring to FIG. 1*a*, there is shown a side view of an ink jet chamber assembly 10 situated upon a substrate 20, which illustrates the creation of vertical structures (hereafter called a chamber wall) 30 by exposing a photo-imageable material 40 through a first mask 50. First mask 50 is designed to both block and pass the exposing light 60. The exposing light 60 that is passed by first mask 50 prepares the exposed portion of the photo-imageable material 40 through its entire thickness down to the substrate 20. This produces an exposed photo-imageable material that becomes the chamber walls 30 horizontally adjacent to the thermal element 70. The exposing light 60 used for exposing the photo-imageable material 40 through the first mask 50 can be variably adjustable in intensity, dose, and wavelength for the purpose of modifying the resultant structures produced in the photo-imageable material 40. In regards to wavelengths of the exposing light 60, those wavelengths can consist of a plurality of conditions including fixed, variable, single, dual, multiple or mixed.

In the preferred embodiment, for example, the wavelength of the exposing light 60 is at 365 nm corresponding to the I-line of a mercury light source. The exposure is performed with a contact or proximity aligner. Alternatively an I-line stepper can be used.

A typical photo-imageable material used in this invention is SU-8 2000 Photoresist available from MicroChem Corporation of Newton Mass. SU-8 2000 (formulated in cyclopentanone) is a chemically-amplified, epoxy-based negative resist. Standard formulations are offered to cover a wide range of film thicknesses from <1 μm to >200 μms. The SU-8 2000 resist has a high functionality, high optical transparency and is sensitive to near UV radiation. Images having exceptionally high aspect ratios and straight sidewalls are readily formed in thick films by contact-proximity or projection printing. Cured SU-8 2000 is highly resistant to solvents, acids and bases and has excellent thermal stability, making it well suited for applications in which cured structures are a permanent part of the device.

Figure 1B:
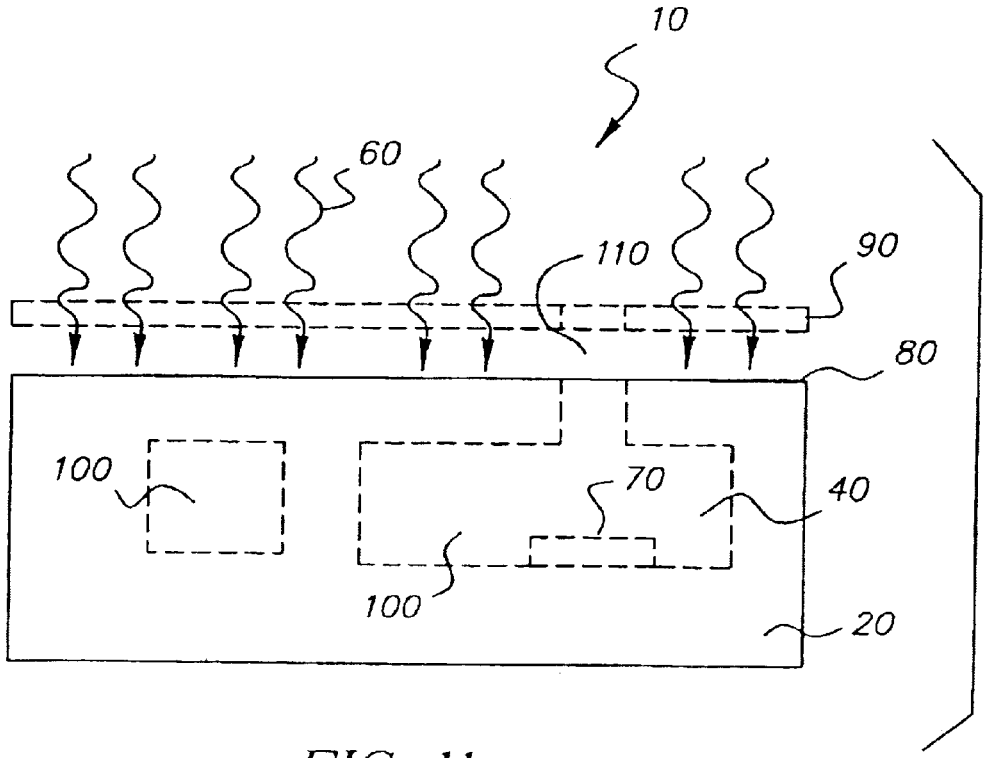
FIG. 1*b* is a side view of an ink jet chamber of the present invention situated upon a substrate, showing the creation of features by exposing a photo-imageable material through a second mask.

Referring now to FIG. 1*b*, there is illustrated a side view of an ink jet chamber assembly 10, of the present invention. It is positioned upon a substrate 20, showing the creation of a horizontal structure (hereafter called a chamber roof) 80 by exposing the photo-imageable material 40 (from FIG. 1*a*) through a second mask 90. It is apparent to those skilled in the art that the first mask 50 has been discarded and replaced by second mask 90. Second mask 90 is designed to both block and pass the exposing light 60. The light that is passed by second mask 90 prepares the photo-imageable material 40 for producing an exposed photo-imageable material 40, which becomes the chamber roof 80 positioned vertically above and adjacent the thermal element 70. This second exposure is preferably performed immediately following the first exposure described in FIG. 1*b*. Alternatively, for robustness, a short baking under heat is performed prior to second exposure. The exposing light 60 used for exposing the photo-imageable material 40 through the second mask 90 can be variably adjustable in intensity, dose, and wavelength for the purpose of modifying the resultant structures produced in the photo-imageable material 40 (from FIG. 1*a*). In regards to wavelengths of the exposing light 60, those wavelengths can consist of a plurality of conditions including fixed, variable, single, dual, multiple or mixed.

In a preferred embodiment, the wavelength of the second exposing light 60 is at 365 nm and the process described after the first mask 50 is repeated. In an alternative embodiment, the wavelength of the second exposure light is selected from lower wavelength lines of a mercury light source. For example, lines in the 320 nm wavelength region can be used. The reduced transparency of the photo-imageable material 40 at this lower wavelength allows finer tuning of the chamber roof thickness 80 and also provides less dependence on substrate reflectivity.

Still referring to FIG. 1*b*, a shaded area that represents unexposed photo-imageable material 100 remains (formerly 40 at FIG. 1*a*). It will be instructive to note that a semi-finished ink jet chamber exists with both exposed chamber walls 30 and an exposed chamber roof 80, and that the aforementioned controlled variability of the exposing light 60 is used to control both the height of the chamber walls 30 and the thickness of the chamber roof 80, as described hereinabove. The lack of any exposure over the thermal element 70 creates by default an ink jet nozzle 110. At this point, the chamber walls 30 and chamber roof 80 are baked to complete the hardening process for the exposed photo-imageable material 40, but leaves any unexposed photo-imageable material 100 unaffected and removable. The removal of the unexposed photo-imageable material is accomplished by flushing with a solvent such as cyclopentanone. After flushing is complete, a final cure at a temperature of at most 200 degrees Centigrade finalizes the ink jet chamber assembly 10 drawn in FIG. 1*c*.

Figure 1C:
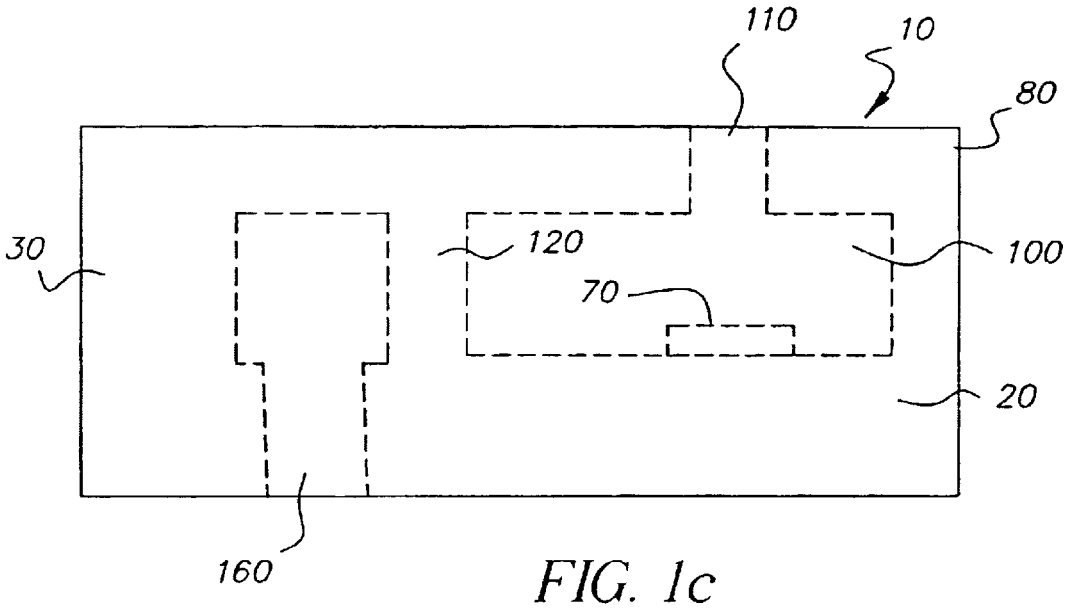
FIG. 1*c* is a side view of an ink jet chamber of the present invention situated upon a substrate, showing finished features after curing and removal of uncured and unexposed photo-imageable material.

Referring to FIG. 1*c*, there is illustrated a side view of the completed and processed ink jet chamber assembly 10 of the present invention. It is positioned upon a substrate 20, and shows chamber walls 30 upon which is situated a chamber roof 80 and an ink jet nozzle 110 created by washing out the unexposed photo-imageable material 100 (the process described in the previous paragraph). The ink jet nozzle 110 is shown disposed substantially directly above and adjacent the thermal element 70, and adjacent to a vertical support member 120. It is instructive to note that a supply port 160 is subsequently put into the substrate 20 for permitting inks or fluids to pass into the ink jet chamber assembly 10.

Figure 2A:
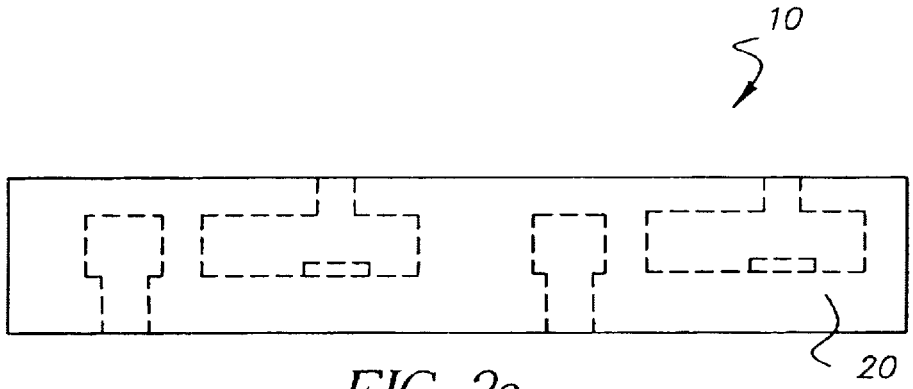
FIG. 2*a* is a side view of an ink jet chamber of the present invention, situated upon a substrate, showing multiple ink jet chambers with substantially similar chamber volumes and output nozzles.

Referring now to FIG. 2*a*, there is shown a side view of a plurality of ink jet chambers 10. The process as described previously was, for descriptive clarity, described for creating a single ink jet chamber 10. However, the present invention also provides the ability to produce a plurality of ink jet chamber assemblies 10 upon the same substrate 20, which greatly enhances the reduced complexity, reduced manufacturing steps and lower costs achieved by the methods described in this invention. Those skilled in the art will readily be able to apply the above teachings to the plurality of ink jet chambers 10. Additionally, it is instructive to note that FIG. 2*a* details a plurality of ink jet chamber assemblies 10 with essentially the same internal structure and volumes with regards to one another.

Figure 2B:
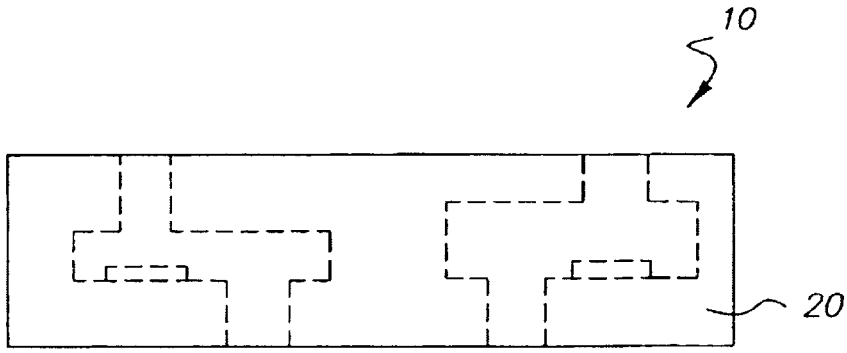
FIG. 2*b* is a side view of an ink jet chamber of the present invention, situated upon a substrate, showing multiple ink jet chambers with substantially different chamber volumes and output nozzles.

Referring next to FIG. 2*b*, there is shown the ink jet chamber assemblies 10 situated on the substrate 20, and having different internal structure and volumes with respect to one another, such as nozzle dimensions and chamber volumes. This illustrates how the present invention can be modified by using different masks along with different exposures to control the formation of different features in a plurality of ink jet chamber assemblies 10.

Figure 3A:
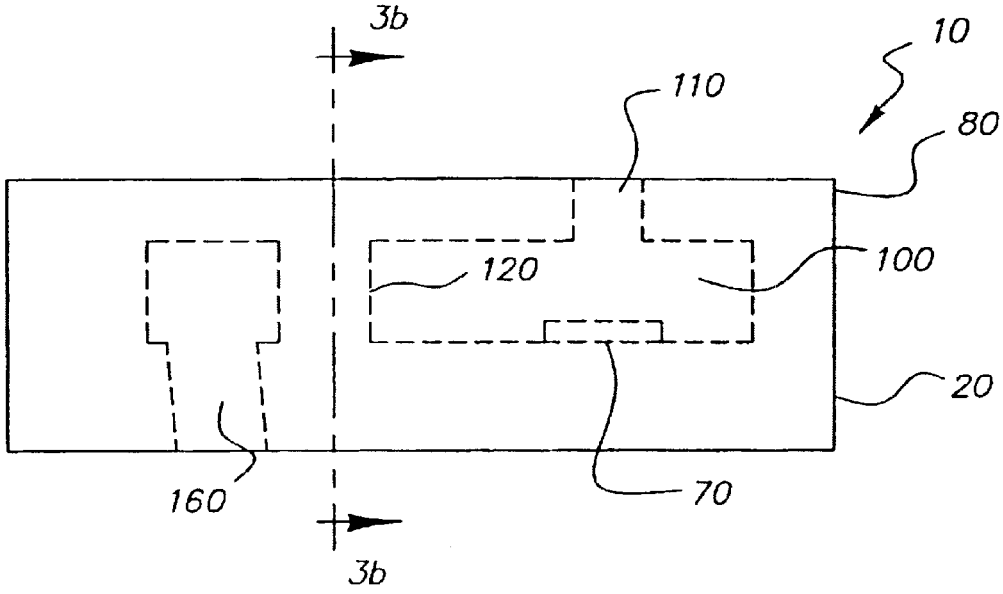
FIG. 3*a* is a side view of an ink jet chamber of the present invention where an internal member provides a plurality of functions.
Figure 3B:
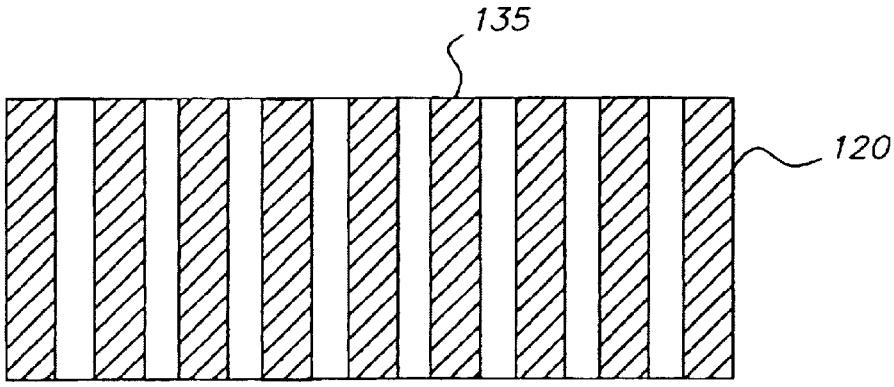
FIG. 3*b* is an end view of the ink jet chamber of the present invention taken along line 3*b*—3*b* of FIG. 3*a*.

Referring next to FIGS. 3*a* and 3*b*, there is illustrated a finished and cured ink jet chamber assembly 10 situated on substrate 20. A vertical support member 120 is a support for the chamber roof 80, but it can also be manufactured with an additional function in mind such as filtering an impurity such as dust that may be suspended within a supplied ink or fluid (not shown). This filtering function would be engineered in a manner that integrates the filter as a plurality of posts 135 across the ink jet chamber with predetermined spacing between the posts 135 for the blocking of impurities and drawn in FIG. 3*b*. Supplied inks or fluids (not shown) would be sourced from a reservoir (not shown) through the supply port 160. Alternatively, posts 135 may be a single integrated wall composed of a porous material for permitting the filtering. Additionally, post 135 may serve as baffles.

In operate the ink jet chamber, electrical energies applied to the thermal element 70 ejects inks or fluids (not shown) from an ink jet chamber assembly 10 through an ink jet nozzle 110. The process of ejecting ink creates shock waves within the ink jet chamber assembly 10 that are severe enough to limit the lifetime of the ink jet chamber assembly 10. Baffles serve the function of dampening the shock waves thus increasing the lifetime of the ink jet chamber assembly 10.

Figure 4:
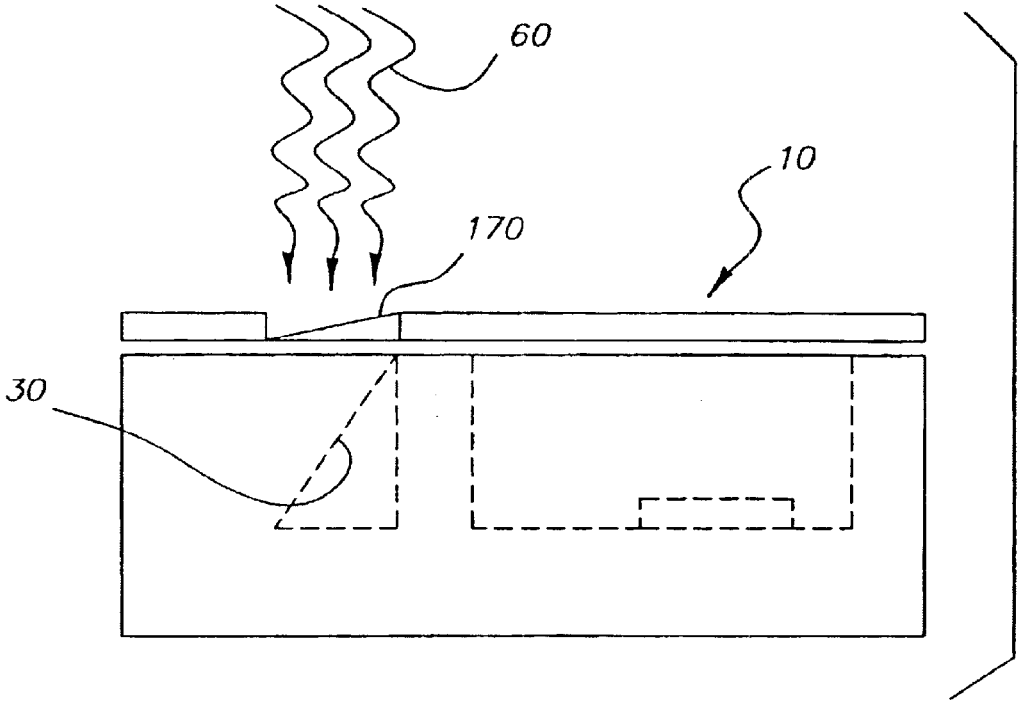
FIG. 4 is a side view of an ink jet chamber of the present invention in which a gradient mask creates plurality of geometrically shaped structures.

Referring now to FIG. 4, there is shown an alternative method for producing chamber walls 30 that have a slanted chamber wall 180. In this case, exposing light 60 passes through a gradient mask 170 for producing the slanted chamber walls.

Figure 5A:
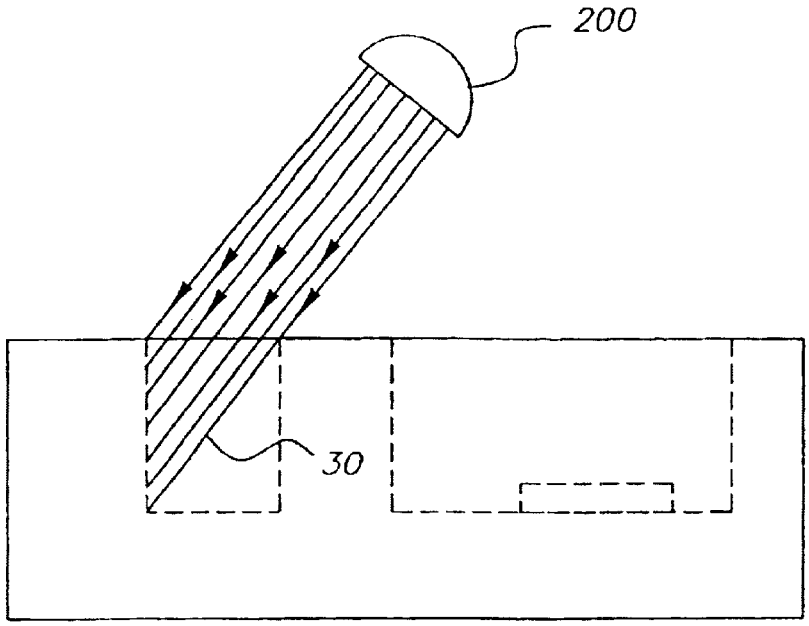
FIG. 5*a* is a side view of an ink jet chamber of the present invention in which a collimated light source creates plurality of geometrically shaped structures.
Figure 5B:
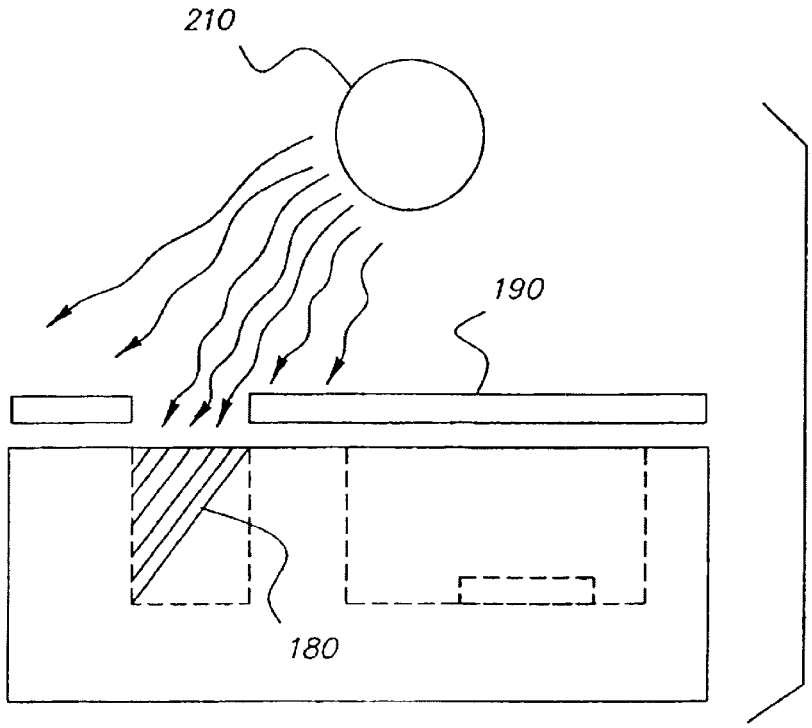
FIG. 5*b* is a side view of an ink jet chamber of the present invention in which an uncollimated light source creates plurality of geometrically shaped structures by exposing through a mask.

Referring next to FIG. 5*a*, the same effect can be achieved by using a collimated light source 200 to directly expose the photo-imageable material 40 (referring back to FIG. 1*a*) or using an un-collimated light source 210 through a third mask 190 detailed in FIG. 5*b*.

The invention has been described with reference to a preferred embodiment. However, it will be appreciated that variations and modifications can be effected by a person of ordinary skill in the art without departing from the scope of the invention.

PARTS LIST

10 ink jet chamber assembly/assemblies
20 substrate
30 vertical structures (chamber wall)
40 photo-imageable material
50 first mask
60 exposing light
70 thermal element
80 horizontal Structure (chamber roof)
90 second mask
100 unexposed and uncured epoxy photo-imageable material
110 ink jet nozzle
120 vertical support member
135 posts
160 supply port
170 gradient mask
180 slanted chamber wall
190 third mask
200 collimated light source
210 un-collimated light source

What is claimed:

1. A method for creating one or more ink jet chambers, the method comprising the steps of:

(a) providing a substrate having a thermal element covered with substantially one type of uncured photo-imageable material;

(b) providing a first mask spanning the thermal element which creates both masked and unmasked uncured photo-imageable regions;

(c) exposing the unmasked photo-imageable region;

(d) providing a second mask covering at least a portion of the thermal element;

(e) exposing a portion of the remaining unexposed photo-imageable region for forming an output nozzle;

(f) curing the exposed portions of the photo-imageable material; and (g) removing all the remaining uncured photo-imageable material for creating the ink jet chamber.

2. The method as in claim 1, wherein step (e) includes creating an ink jet cartridge chamber.

3. The method as in claim 1 further comprising the step of creating one more members in the ink jet cartridge chamber.

4. The method as in claim 3, wherein the one or more members is capable of providing a plurality of functions.

5. The method as in claim 3, wherein the functions include support, filtering, and baffling.

6. The method as in claim 1 further comprising the steps of creating a plurality of individualized ink jet chambers on the substrate.

7. The method as in claim 6 further comprising the step of varying the exposure intensity spanning the photo-imageable materials for varying thickness of a chamber roof and depth of the ink jet cartridge chamber.

8. The method as in claim 6 further comprising the step of varying the exposure time spanning the photo-imageable materials for varying thickness of a chamber roof and depth of the ink jet cartridge chamber.

9. The method as in claim 6 further comprising the step of varying the exposure dose spanning the photo-imageable materials for varying thickness of a chamber roof and depth of the ink jet cartridge chamber.

10. The method as in claim 6 further comprising is a step of varying a gradient of the exposure spanning the photo imaging material for a plurality of geometric shaped structures.

11. The method as in claim 1, wherein the exposure wavelength is selected to control a depth of penetration into the photo-imageable material.

12. The method as in claim 11, wherein the first exposure is at a higher wavelength than the second exposure.

13. The method as in claim 11, wherein the second exposure contains a same wavelength as the first exposure in addition to a second lower wavelength.

* * * * *

UNITED STATES PATENT AND TRADEMARK OFFICE

CERTIFICATE OF CORRECTION

PATENT NO. : 7,029,099 B2
APPLICATION NO. : 10/697595
DATED : April 18, 2006
INVENTOR(S) : John A. Lebens et al.

It is certified that error appears in the above-identified patent and that said Letters Patent is hereby corrected as shown below:

| | |
|---|---|
| Column 6, line 11 | "creating one more members" should read as --creating one or more members-- |
| Column 6, line 32 | "The method as in claim 6 further comprising is a step" should read as --The method as in claim 6 further comprising a step-- |

Signed and Sealed this

Twenty-eighth Day of November, 2006

JON W. DUDAS
*Director of the United States Patent and Trademark Office*